US006428403B1

(12) United States Patent
Kimura et al.

(10) Patent No.: US 6,428,403 B1
(45) Date of Patent: Aug. 6, 2002

(54) POLISHING APPARATUS

(75) Inventors: Norio Kimura; Hozumi Yasuda, both of Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/580,832

(22) Filed: May 30, 2000

Related U.S. Application Data

(62) Division of application No. 09/056,617, filed on Apr. 8, 1998, now Pat. No. 6,077,385.

(51) Int. Cl.[7] ..... B24B 7/22
(52) U.S. Cl. ..... 451/288; 451/443; 451/72
(58) Field of Search ..... 451/288, 287, 451/41, 443, 444, 398, 72, 56

(56) References Cited

U.S. PATENT DOCUMENTS

| | | | | |
|---|---|---|---|---|
| 5,376,216 A | | 12/1994 | Yoshioka et al. | 156/345 |
| 5,384,986 A | | 1/1995 | Hirose et al. | 451/444 |
| 5,476,414 A | | 12/1995 | Hirose et al. | 451/288 |
| 5,651,724 A | | 7/1997 | Kimura et al. | 451/41 |
| 5,670,011 A | | 9/1997 | Togawa et al. | 156/345 |
| 5,695,601 A | | 12/1997 | Kodera et al. | 156/636.1 |
| 5,762,539 A | | 6/1998 | Nakashiba et al. | 451/41 |
| 5,795,215 A | * | 8/1998 | Guthrie et al. | 451/288 |
| 5,842,912 A | * | 12/1998 | Holzapfel et al. | 451/443 |
| 5,916,412 A | | 6/1999 | Nakashiba et al. | 156/345 |
| 6,019,670 A | * | 2/2000 | Cheng et al. | 451/288 |
| 6,024,630 A | * | 2/2000 | Shendon et al. | 451/288 |
| 6,033,520 A | * | 3/2000 | Kimura et al. | 451/288 |
| 6,183,354 B1 | | 2/2001 | Zuniga et al. | |

* cited by examiner

*Primary Examiner*—Robert A. Rose
(74) *Attorney, Agent, or Firm*—Wenderoth, Lind & Ponack, L.L.P.

(57) ABSTRACT

A polishing apparatus for polishing a workpiece such as a semiconductor wafer has a turntable with a polishing cloth mounted on an upper surface thereof, and a top ring for holding a workpiece and pressing the workpiece against the polishing cloth under a first pressing force to polish the workpiece. The top ring has a recess defined therein for accommodating the workpiece therein. A presser ring is vertically movably disposed around the top ring, and is pressed against the polishing cloth under a variable second pressing force. The first and second pressing forces are variable independently of each other, and the second pressing force is determined based on the first pressing force. Relative rotation between the top ring and the presser ring is achieved during polishing.

8 Claims, 10 Drawing Sheets

POLISHING APPARATUS

The present application is a Division of Ser. No. 09/056,617 filed Apr. 8, 1998 now U.S. Pat. No. 6,077,385.

BACKGROUND OF THE INVENTION

1. Field of the Invention

The present invention relates to a polishing apparatus for polishing a workpiece such as a semiconductor wafer to a flat mirror finish, and more particularly to a polishing apparatus having a mechanism which can control the amount of material removed from a peripheral portion of the workpiece by a polishing action.

2. Description of the Related Art

Recent rapid progress in semiconductor device integration demands smaller and smaller wiring patterns or interconnections and also narrower spaces between interconnections which connect active areas. One of the processes available for forming such interconnection is photolithography.

Though the photolithographic process can form interconnections that are at most 0.5 $\mu$m wide, it requires that surfaces on which pattern images are to be focused by a stepper be as flat as possible because the depth of focus of the optical system is relatively small.

Conventionally, a polishing apparatus has a turntable and a top ring which rotate at respective individual speeds. A polishing cloth is attached to the upper surface of the turntable.

A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated. This process is called Chemical Mechanical Polishing. operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated. This process is called Chemical Mechanical polishing.

If the semiconductor wafer is not pressed against the polishing cloth under forces which are uniform over the entire surface of the semiconductor wafer, then the semiconductor wafer tends to be polished insufficiently or excessively in local areas depending on the applied forces. The following arrangements have been proposed in the art to prevent the semiconductor wafer from being pressed against the polishing cloth under irregular forces.

1) One conventional solution has been to apply an elastic pad of polyurethane or the like to a workpiece holding surface of the top ring for uniformizing a pressing force applied from the top ring to the semiconductor wafer.
2) According to another solution, the top ring, i.e., a workpiece carrier for holding a semiconductor wafer, is tiltable with respect to the surface of the polishing cloth.
3) Still another attempt has been to press a region of the polishing cloth surrounding the semiconductor wafer, independently of the semiconductor wafer, for thereby eliminating an appreciable step between a region of the polishing cloth pressed by the semiconductor wafer and the surrounding region thereof.

FIG. 8 of the accompanying drawings shows a conventional polishing apparatus. As shown in FIG. 8, the conventional polishing apparatus comprises a turntable 41 with a polishing cloth 42 attached to an upper surface thereof, a top ring 45 for holding a semiconductor wafer 43 to press the semiconductor wafer 43 against the polishing cloth 42, and an abrasive liquid supply nozzle 48 for supplying an abrasive liquid Q to the polishing cloth 42. The top ring 45 is connected to a top ring shaft 49, and is provided with an elastic pad 47 of polyurethane or the like on its lower surface. The semiconductor wafer 43 is held by the top ring 45 in contact with the elastic pad 47. The top ring 45 also has a cylindrical presser ring 46A on an outer circumferential edge thereof for retaining the semiconductor wafer 43 on the lower surface of the top ring 45. Specifically, the presser ring 46A is fixed to the top ring 45, and has a lower end projecting downwardly from the lower surface of the top ring 45 for holding the semiconductor wafer 43 on the elastic pad 47 against removal from the top ring 45 under frictional engagement with the polishing cloth 42 during a polishing process.

In operation, the semiconductor wafer 43 is held against the lower surface of the elastic pad 47 which is attached to the lower surface of the top ring 45. The semiconductor wafer 43 is then pressed against the polishing cloth 42 on the turntable 41 by the top ring 45, and the turntable 41 and the top ring 45 are rotated independently of each other to move the polishing cloth 42 and the semiconductor wafer 43 relatively to each other, thereby polishing the semiconductor wafer 43. The abrasive liquid Q comprises an alkaline solution containing abrasive grains of fine particles suspended therein, for example. The semiconductor wafer 43 is polished by a composite action comprising a chemical polishing action of the alkaline solution and a mechanical polishing action of the abrasive grains.

FIG. 9 of the accompanying drawings shows in a fragmental cross-section the semiconductor wafer 43, the polishing cloth 42, and the elastic pad 47. As shown in FIG. 9, the semiconductor wafer 43 has a peripheral portion which is a boundary between contact and noncontact with the polishing cloth 42 and also is a boundary between contact and noncontact with the elastic pad 47. At the peripheral portion of the semiconductor wafer 43, the polishing pressure applied to the semiconductor wafer 43 by the polishing cloth 42 and the elastic pad 47 is not uniform, thus the peripheral portion of the semiconductor wafer 43 is liable to be polished to an excessive degree. As a result, the peripheral edge of the semiconductor wafer 43 is often polished, in a so called "edge-rounding" manner.

In order to prevent the peripheral portion of the semiconductor wafer from being excessively polished, there has been proposed in Japanese patent application No. 8-54055 a polishing apparatus having a structure for pressing an area of the polishing cloth which is located around the peripheral portion of the semiconductor wafer.

FIG. 10 of the accompanying drawings shows the polishing apparatus disclosed in Japanese patent application No. 8-54055.

As shown in FIG. 10, a semiconductor wafer 43 is held by a top ring 45 and pressed against a polishing cloth 42 on a turntable 41. The semiconductor wafer 43 is retained on the top ring 45 by a cylindrical retaining portion extending downwardly from the top ring 45. A presser ring 46 is disposed around and connected to the top ring 45 by keys 58.

The keys 58 allow the presser 5 ring 46 to move vertically with respect to the top ring 45 and to rotate together with the top ring 45. The presser ring 46 is rotatably supported by a radial bearing 59 which is held by a bearing holder 60 operatively coupled by a plurality of (e. g. three) circumferentially spaced shafts 61 to a plurality of (e.g. 10 three) circumferentially spaced presser ring air cylinders 62. The presser ring air cylinders 62 are fixedly mounted on a top ring head 69. The top ring 45 has an upper surface held in sliding contact with a spherical bearing 65 that is slidably supported on the lower end of a top ring shaft 66. movable by a top ring air cylinder 67 mounted on the top ring head 69 and operatively connected to the top ring shaft 66.

The top ring air cylinder 67 and the presser ring air cylinders 62 are connected to a compressed air source 64 respectively through regulators R1 and R2. The regulator R1 regulates the air pressure supplied from the compressed air source 64 to the top ring air cylinder 67 to adjust the pressing force for pressing the semiconductor wafer 43 against the polishing cloth 42 by the top ring 45. The regulator R2 regulates the air pressure supplied from the compressed air source 64 to the presser ring air cylinders 62 to adjust the pressing force for pressing the presser ring 46 against the polishing cloth 42. By adjusting the pressing force of the presser ring 46 with respect to the pressing force of the top ring 45, the distribution of polishing pressures is made continuous and uniform from the center of the semiconductor wafer 43 to its peripheral edge and further to the outer circumferential edge of the presser ring 46 disposed around the semiconductor wafer 43. Consequently, the peripheral portion of the semiconductor wafer 43 is prevented from being polished excessively or insufficiently.

In the polishing apparatus proposed in Japanese patent application No. 8-54055, the top ring 45 and the presser ring 46 are integrally rotated, thus there occurs no relative rotation between the semiconductor wafer 43 held by the lower surface of the top ring 45 and the presser ring 46. Therefore, the polishing is performed in such a state that the outer circumferential edge of the semiconductor wafer 43 and the inner circumferential surface of the presser ring 46 are always in confrontation with each other at the same portions or areas.

However, the pressing surface, i.e., the lower end surface of the presser ring 46 is not necessarily flat microscopically, and has undulations or irregularities, and hence there occurs a small difference locally in deformation of the polishing cloth to lead to nonuniform deformation of the polishing cloth around the semiconductor wafer. This nonuniform deformation of the polishing cloth affects the amount of the material removed from the peripheral portion of the semiconductor wafer, and the entire peripheral portion of the semiconductor wafer cannot be polished uniformly. Further, since the presser ring does not have uniform vertical thickness in an entire circumference, the entire peripheral portion of the semiconductor wafer also cannot be polished uniformly.

Further, in the polishing apparatus disclosed in Japanese patent application No. 8-54055, by pressing a wide area of the polishing cloth around the peripheral portion of the semiconductor wafer by the presser ring, the distribution of applied polishing pressures, which result from a combination of the pressing forces exerted by the top ring and the presser ring, is continuous and uniform from the center of the semiconductor wafer to its peripheral edge and further to an outer circumferential edge of the presser ring. Therefore, the presser ring is required to have a relatively large radial thickness, providing a relatively large surface area on its lower pressing surface. Insofar as the surface of the polishing cloth and the lower surface of the presser ring lie parallel to each other, no problem arises. However, if the surface of the polishing cloth and the lower surface of the presser ring are brought out of parallelism with each other due to undulations or irregularities of the surface of the polishing cloth, then only an outer peripheral portion of the presser ring 46 presses the polishing cloth 42 as shown in FIG. 11 of the accompanying drawings. When the condition of the polishing cloth shown in FIG. 11 occurs, the polishing cloth 42 tends to rise near the peripheral portion of the semiconductor wafer 43, and hence the peripheral portion of the semiconductor wafer 43 is liable to be polished to an excessive degree, thus causing edge-rouding.

The top ring 45 needs to provide a downwardly open recess in its lower surface for holding the semiconductor wafer 43 therein. Such a downwardly open recess may be formed by an outer circumferential wall extending downwardly integrally from the top ring 45 or an annular retainer ring fixedly provided around the top ring 45. If the top ring 45 is made of ceramics, then it is not practical to provide the top ring 45 with such a downwardly extending outer circumferential wall from the viewpoint of machining or production cost. Another way of providing a downwardly open recess in the lower surface of the top ring 45 is to secure a retainer ring 50 around the top ring 45, as shown in FIG. 11. With the retainer ring 50 interposed between the outer circumferential edge of the semiconductor wafer 43 and the presser ring 46, the distance between the inner circumferential edge of the presser ring 46 and the outer circumferential edge of the semiconductor wafer 43 is so large that the presser ring 46 fails to press the polishing cloth 42 near the outer circumferential edge of the semiconductor wafer 43. As a result, the polishing cloth 42 tends to rise near the outer circumferential edge of the semiconductor wafer 43 which is then excessively polished into an edge-rounding.

SUMMARY OF THE INVENTION

It is therefore an object of the present invention to provide a polishing apparatus having a presser ring disposed around a top ring which can prevent a peripheral portion of the workpiece from being polished excessively or insufficiently for thereby polishing the workpiece to a highly planarized finish.

According to one aspect of the present invention, there is provided a polishing apparatus comprising: a turntable with a polishing cloth mounted on an upper surface thereof, a top ring for holding a workpiece and pressing the workpiece against the polishing cloth under a first pressing force to polish the workpiece, the top ring having a retaining portion for retaining an outer circumferential edge of the workpiece; a presser ring positioned outwardly of the retaining portion, the presser ring being vertically movable relative to the top ring, with relative rotation between the top ring and the presser ring being achieved; and a pressing device for pressing the presser ring against the polishing cloth under a second pressing force which is variable.

With the above arrangement, since relative rotation between the top ring and the presser ring is achieved, relative movement between the semiconductor wafer held by the lower surface of the top ring and the presser ring is achieved, and polishing is performed in such a state that the outer circumferential edge of the semiconductor wafer and the inner circumferential surface of the presser ring are always in confrontation with each other at different portions or areas. Thus, even if the presser ring has a pressing surface with undulations or irregularities, or nonuniform vertical thickness, and hence the polishing cloth around the semiconductor wafer is not uniformly deformed, the amount of material removed from the semiconductor wafer can be uniformized over the entire peripheral portion of the semiconductor wafer. Consequently, the entire peripheral portion of the semiconductor wafer can be polished uniformly.

According to another aspect of the present invention, there is provided a polishing apparatus comprising: a turntable with a polishing cloth mounted on an upper surface thereof; a top ring for holding a workpiece and pressing the workpiece against the polishing cloth under a first pressing force to polish, the workpiece, the top ring having a retaining portion for retaining an outer circumferential edge of the workpiece; a presser ring positioned outwardly of the retaining portion, the presser ring being vertically movable relative to the top ring, and the presser ring having a ridge projecting downwardly from an inner peripheral portion thereof and forming on a lower end thereof a pressing surface which contacts the polishing cloth; and a pressing device for pressing the presser ring against the polishing cloth under a second pressing force which is variable.

With the above arrangement, the ridge projects downwardly from the inner peripheral portion of the presser ring and the lower end surface of the ridge serves as a pressing surface for pressing the polishing cloth downwardly. Even if the surface of the polishing cloth and the lower surface of the presser ring are brought out of parallelism with each other for some reason, since the pressing surface on the inner peripheral portion of the presser ring presses the polishing cloth, the area of the polishing cloth extending from the pressing surface to the outer circumferential edge of the semiconductor wafer and further to the radially inner area thereof lies continuously flat, thereby providing a continuous and uniform distribution of pressures from the central region to outer circumferential edge of the semiconductor wafer and further to the pressing surface of the presser ring outside of the semiconductor wafer. Accordingly, the outer peripheral portion of the semiconductor wafer is prevented from being polished insufficiently or excessively.

According to still another aspect of the present invention, there is provided a polishing apparatus comprising: a turntable with a polishing cloth mounted on an upper surface thereof; a top ring for holding a workpiece and pressing the workpiece against the polishing cloth under a first pressing force to polish the workpiece, the top ring having a retaining portion for retaining an outer circumferential edge of the workpiece; a presser ring positioned outwardly of the retaining portion, the presser ring being vertically movable relative to the top ring; a pressing device for pressing the presser ring against the polishing cloth under a second pressing force which is variable; and a cleaning liquid supply device for supplying a cleaning liquid to a clearance between the top ring and the presser ring.

The above and other objects, features, and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

Figure 1:
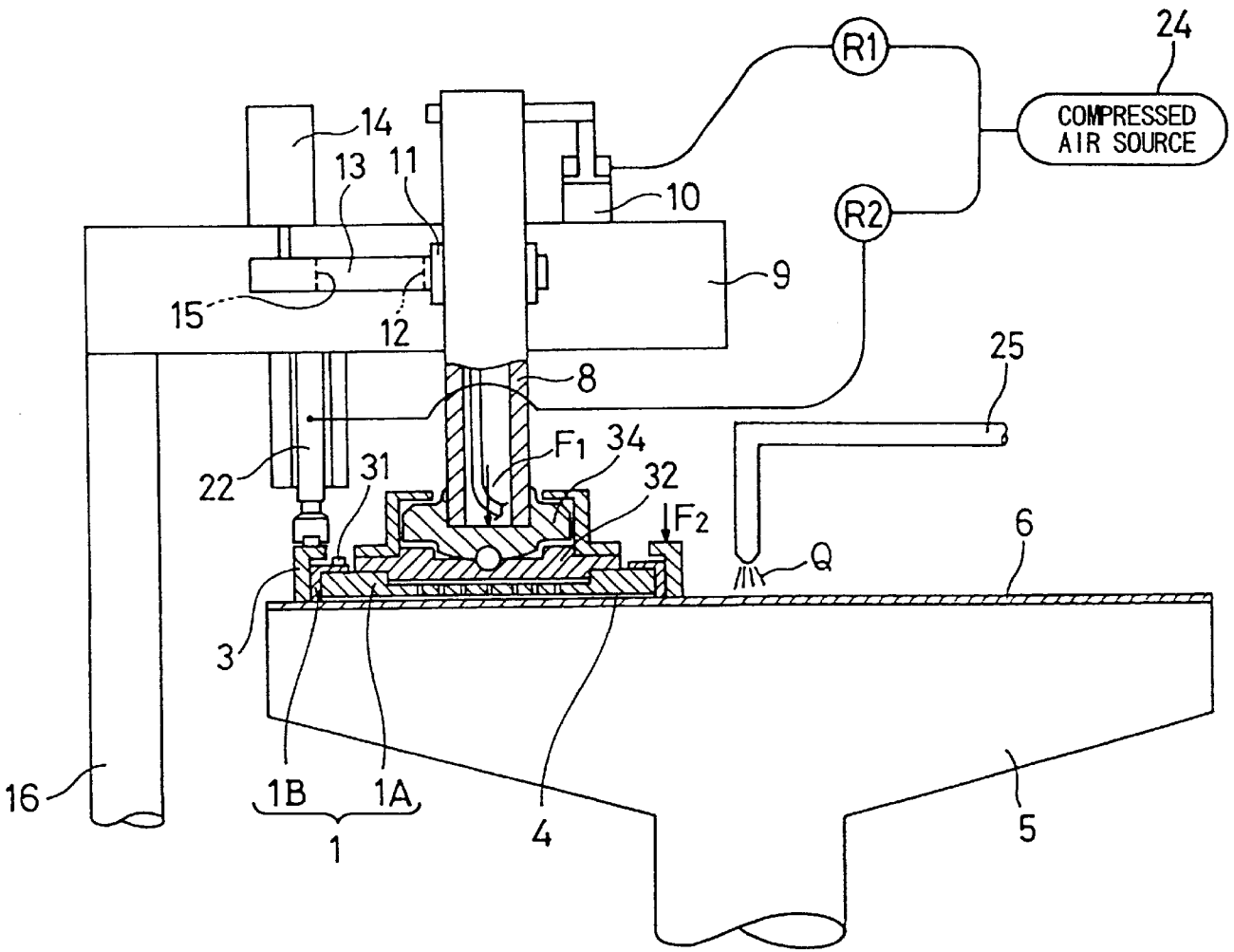
FIG. 1 is a vertical cross-sectional view of a polishing apparatus according to a first embodiment of the present invention.

Next, a polishing apparatus according to embodiments of the present invention will be described below with reference to the drawings. Like or corresponding parts are denoted by like or corresponding reference numerals throughout the views.

Figure 2:
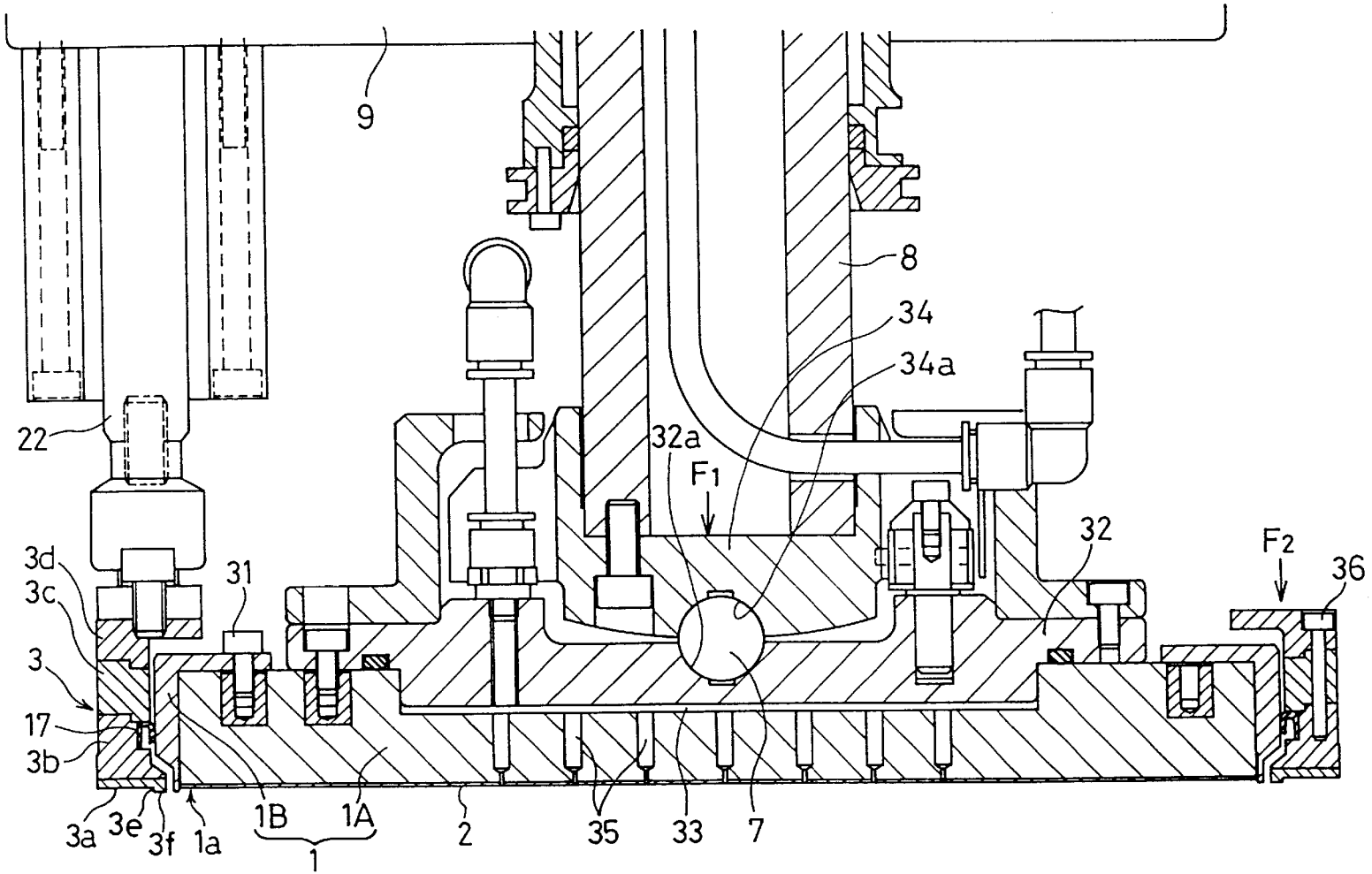
FIG. 2 is an enlarged fragmentary vertical cross-sectional view of polishing of the apparatus shown in FIG. 1.

As shown in FIGS. 1 and 2, a polishing apparatus of a first embodiment of the present invention has a top ring 1 comprising a top ring body 1A and a retainer ring 1B detachably fixed to an outer circumferential edge of the top ring body 1A by bolts 31. The top ring 1 has a recess la for accommodating a semiconductor wafer 4 therein. The recess 1*a* is defined jointly by a lower surface of the top ring body 1A and an inner circumferential surface of the retainer ring 1B. The semiconductor wafer 4 accommodated in the recess la has an upper surface held by the lower surface of the top ring body 1A and an outer circumferential edge held by the inner circumferential surface of the retainer ring 1B. A presser ring 3 is vertically movably disposed around the retainer ring 1B. An elastic member 17 having a U-shaped cross-section for preventing the top ring 1 from being tilted excessively is disposed between the top ring 1 and the presser ring 3.

The top ring 1 also includes an elastic pad 2 of polyurethane or the like attached to the lower surface of the top ring 1. The semiconductor wafer 4 disposed in the recess la has its upper surface held against the elastic pad 2.

The polishing apparatus also has a turntable 5 disposed below the top ring 1, and a polishing cloth 6 attached to an upper surface of the turntable 5. An attachment flange 32 having an upwardly open semispherical recess 32*a* defined in an upper surface thereof is fixedly mounted on an upper surface of the top ring body 1A. A vertical top ring shaft 8 is disposed coaxially above the top ring 1, and a drive shaft flange 34 having a downwardly open semispherical recess

34*a* is fixedly mounted on the lower end of the top ring shaft 8. A spherical bearing 7 comprising a ball is received in the semispherical recesses 32*a* and 34*a*. The top ring body 1A and the attachment flange 32 jointly define a gap or space 33 therebetween which can be evacuated or supplied with a compressed air or a liquid such as water. The top ring body 1A has a plurality of vertical communication holes 35 defined therein which communicate with the space 33 and are open at the lower surface of the top ring body 1A. The elastic pad 2 also has a plurality of openings which are in communication with the respective communication holes 35. Therefore, the upper surface of the semiconductor wafer 4 (see FIG. 1) held in the recess la can be attracted to the top ring body 1A under vacuum developed in the space 33. Further, the upper surface of the semiconductor wafer 4 held in the recess la can be supplied with a liquid or a compressed air from the space 33.

The top ring shaft 8 is rotatably supported by a top ring head 9 and operatively coupled to a top ring air cylinder 10 fixedly mounted on the top ring head 9. The top ring shaft 8 is vertically movable by the top ring air cylinder 10 for pressing the semiconductor wafer 4 held by the top ring 1 against the polishing cloth 6 on the turntable 5.

The top ring shaft 8 is connected through a key (not shown) to a rotatable sleeve 11 in the top ring head 9. The rotatable sleeve 11 has a timing pulley 12 mounted on its outer circumferential surface and operatively connected through a timing belt 13 to a timing pulley 15. The timing pulley 15 is mounted on the rotatable shaft of a top ring motor 14 that is fixedly mounted on the top ring head 9.

Therefore, when the top ring motor 14 is energized, the sleeve 11 and the top ring shaft 8 are rotated in unison with each other through the timing pulley 15, the timing belt 13, and the timing pulley 12 to thereby rotate the top ring 1. The top ring head 9 is supported on an upper end of a vertical top ring head shaft 16 fixedly supported on a frame (not shown).

Figure 3:
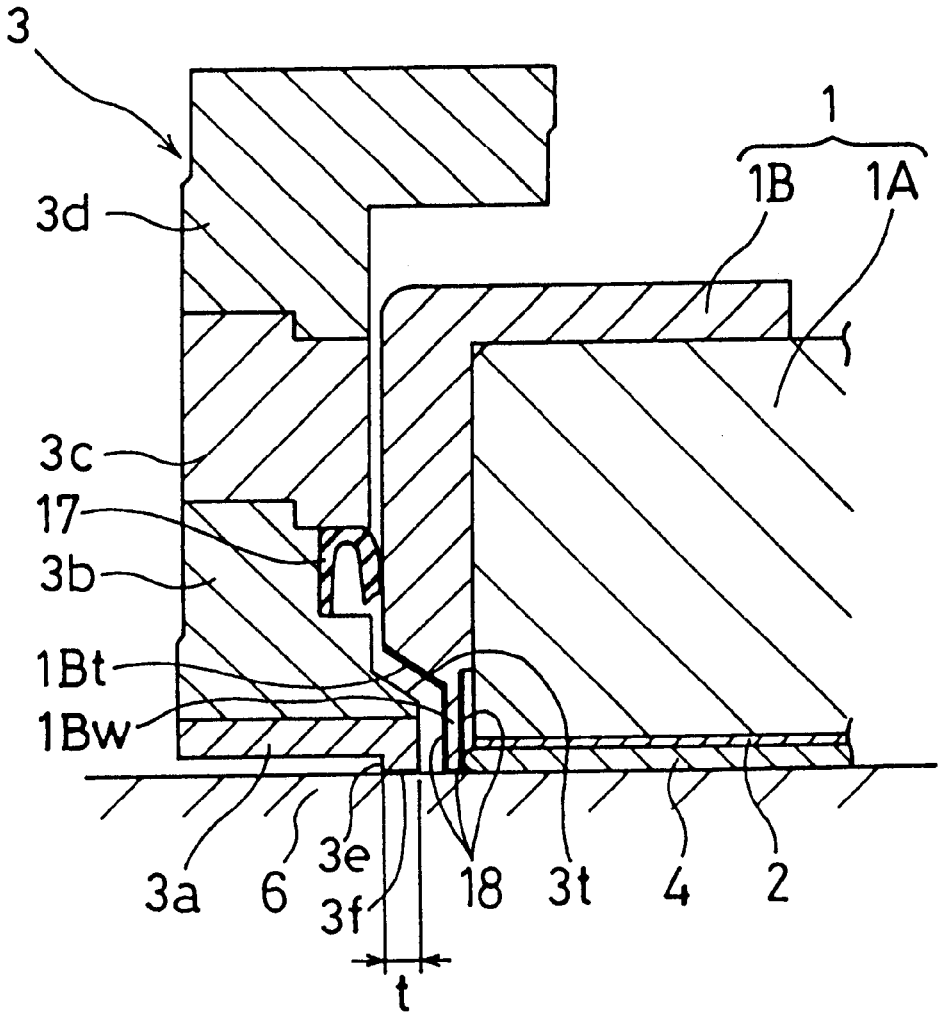
FIG. 3 is an enlarged fragmentary vertical cross-sectional view of a portion the polishing apparatus shown in FIG. 2.

As shown in FIGS. 2 and 3, the presser ring 3 disposed around the top ring 1 comprises a vertical stack of presser ring members including a first presser ring member 3*a* made of alumina ceramics and disposed at a lowermost position, second and third presser ring members 3*b*, 3*c* made of stainless steel and disposed upwardly of the first presser ring member 3*a*, and a fourth presser ring member 3*d* made of stainless steel and disposed at an uppermost position. The second through fourth presser ring members 3*b*–3*d* are interconnected by bolts 36, and the first presser ring member 3*a* is fixed to the second presser ring member 3*b* by adhesion or the like. The first presser ring member 3*a* has an annular ridge 3*e* projecting downwardly from an inner peripheral portion thereof, which annular ridge 3*e* has a pressing surface 3*f* on its lower end for pressing the polishing cloth 6. The pressing surface 3*f* has a radial width or thickness t in the range of from 2 to 6 mm.

The presser ring 3 has an upper end coupled to a plurality of presser ring air cylinders 22 (e.g. three) that are fixedly connected to the top ring head 9. The retainer ring 1B is made of a metal such as stainless steel, and has on its outer circumference a tapered surface 1Bt that is inclined radially inwardly in a downward direction. The retainer ring 1B has a thin wall portion 1Bw extending downwardly from the tapered surface 1Bt. The thin wall portion 1Bw is thinner than the portion of the retainer ring 1B above the lower end of the tapered surface 1Bt. The presser ring 3 has on its inner circumference a tapered surface 3*t* that is inclined radially inwardly in a downward direction complementarily to the tapered surface 1Bt of the retainer ring 1B. These tapered surfaces 1Bt, 3*t* and the thin wall portion 1Bw of the retainer ring 1B allow the pressing surface 3*f* to be positioned as closely as possible to the outer circumferential edge of the semiconductor wafer 4 which is held by the top ring 1.

Because the distance between the inner circumferential edge of the pressing surface 3*f* and the outer circumferential edge of the semiconductor wafer 4 is minimized, the presser ring 3 can press the polishing cloth 6 downwardly near the outer circumferential edge of the semiconductor wafer 4 for thereby preventing the outer circumferential edge of the semiconductor wafer 4 from being excessively polished. As shown in FIG. 3, the tapered surface 1Bt, and outer, bottom and inner surfaces of the thin wall portion 1Bw of the retainer ring 1B are coated with a layer 18 of a synthetic resin such as polyetherketone (PEEK), polytetrafluoroethylene (PTFE), or polyvinyl chloride (PVC).

The coated layer 18 has a thickness of 100 microns or less. The coated layer 18 on the metal retainer ring 1B is effective to prevent the semiconductor wafer 4 from being contaminated with metal.

As shown in FIG. 1, the top ring air cylinder 10 and the presser ring air cylinders 22 are connected to a compressed air source 24 respectively through regulators R1 and R2. The regulator R1 regulates the air pressure supplied from the compressed air source 24 to the top ring air cylinder 10 to adjust the pressing force of the top ring 1 which presses the semiconductor wafer 4 against the polishing cloth 6. The regulator R2 regulates the air pressure supplied from the compressed air source 24 to the presser ring air cylinders 22 to adjust the pressing force of the presser ring 3 which presses the polishing cloth 6.

In the illustrated embodiment, keys or similar rotation transmitting members are not provided between the top ring 1 and the presser ring 3. Therefore, while the top ring 1 rotates about the axis of the top ring shaft 8 during operation of the polishing apparatus, the presser ring 3 does not rotate about its own axis. That is, relative rotation between the top ring 1 and the presser ring 3 is achieved. Since the rotation of the top ring 1 is not transmitted to the presser ring 3, the load on the top ring shaft 8 when it rotates is relatively small. The polishing apparatus is relatively simple in structure because the presser ring 3 is directly operated by the presser ring air cylinders 22 fixedly mounted on the top ring head 9.

An abrasive liquid supply nozzle 25 is disposed above the turntable 5 for supplying an abrasive liquid Q to the polishing cloth 6.

Operation of the polishing apparatus shown in FIGS. 1 through 3 will be described below.

The semiconductor wafer 4 is held on the lower surface of the elastic pad 2 on the lower surface of the top ring 1, and the top ring air cylinder 10 is operated to press the top ring 1 downwardly toward the turntable 5 for thereby pressing the semiconductor wafer 4 against the polishing cloth 6 on the turntable 5 which is rotating. At the same time, the abrasive liquid Q is supplied from the abrasive liquid supply nozzle 25 onto the polishing cloth 6 and is retained thereon. The lower surface of the semiconductor wafer 4 is polished by the abrasive liquid Q which is present between the lower surface of the semiconductor wafer 4 and the polishing cloth 6. Specifically, the abrasive liquid Q comprises an alkaline solution with fine abrasive particles suspended therein, for example. The semiconductor wafer 4 is polished by a combination of a chemical etching action of the alkali contained in the alkaline solution and a mechanical abrasive action of the fine abrasive particles.

Depending on the force applied from the top ring air cylinder 10 to the top ring 1, the pressing force of the presser ring 3 for pressing the polishing cloth 6 by the presser ring air cylinders 22 is adjusted for thereby polishing the semiconductor wafer 4 properly. As shown in FIG. 1, while the semiconductor wafer 4 is being polished, the pressing force $F_1$ which is applied by the top ring 1 to press the semiconductor wafer 4 against the polishing cloth 6 can be changed by the regulator R1, and the pressing force $F_2$ which is applied by the presser ring 3 to press the polishing cloth 6 can be changed by the regulator R2. Therefore, during the polishing process, the pressing force $F_2$ applied by the presser ring 3 to press the polishing cloth 6 can be changed depending on the pressing force $F_1$ applied by the top ring 1 to press the semiconductor wafer 4 against the polishing cloth 6. By adjusting the pressing force $F_2$ with respect to the pressing force $F_1$, the distribution of polishing pressures is made continuous and uniform from the center of the semiconductor wafer 4 to its peripheral edge and further to the outer circumferential edge of the presser ring 3 disposed around the semiconductor wafer 4. Consequently, the peripheral portion of the semiconductor wafer 4 is prevented from being polished excessively or insufficiently. The semiconductor wafer 4 can thus be polished to a high quality and with a high yield.

If a greater or smaller thickness of material is to be removed from the peripheral portion of the semiconductor wafer 4 than from the inner region of the semiconductor wafer 4, then the pressing force $F_2$ applied by the presser ring 3 is selected to be of a suitable value based on the pressing force $F_1$ applied by the top ring 1 to intentionally increase or reduce the amount of material removed from the peripheral portion of the semiconductor wafer 4.

According to the illustrated embodiment, during the polishing process of the semiconductor wafer 4, the top ring I is rotated about its own axis by the top ring shaft 8, but the presser ring 3 is nonrotatable about its own axis because the presser ring 3 is coupled through the air cylinders 22 to the stationary top ring head 9. Therefore, relative rotation between the semiconductor wafer 4 held by the lower surface of the top ring 1 and the presser ring 3 is achieved, and hence polishing is performed in such a state that the outer circumferential edge of the semiconductor wafer 4 and the inner circumferential surface of the presser ring 3 are always in confrontation with each other at different portions or areas. Thus, even if the presser ring 3 has a pressing surface 3*f* with undulations or irregularities, or nonuniform vertical thickness, and hence the polishing cloth 6 around the semiconductor wafer 4 is not uniformly deformed, the amount of material removed from the semiconductor wafer 4 can be uniformized over the entire peripheral portion of the semiconductor wafer 4. Consequently, the entire peripheral portion of the semiconductor wafer 4 can be polished uniformly.

Further, by disconnecting the presser ring 3 and the air cylinder 22, the presser ring 3 may be rotated independently of the top ring 1 by a friction torque caused by the turntable 5 or a discrete rotating mechanism for rotating the presser ring 3 at a given speed lower than that of the top ring 1, e.g., at a speed of 1/10 of the top ring 1.

Figure 4:
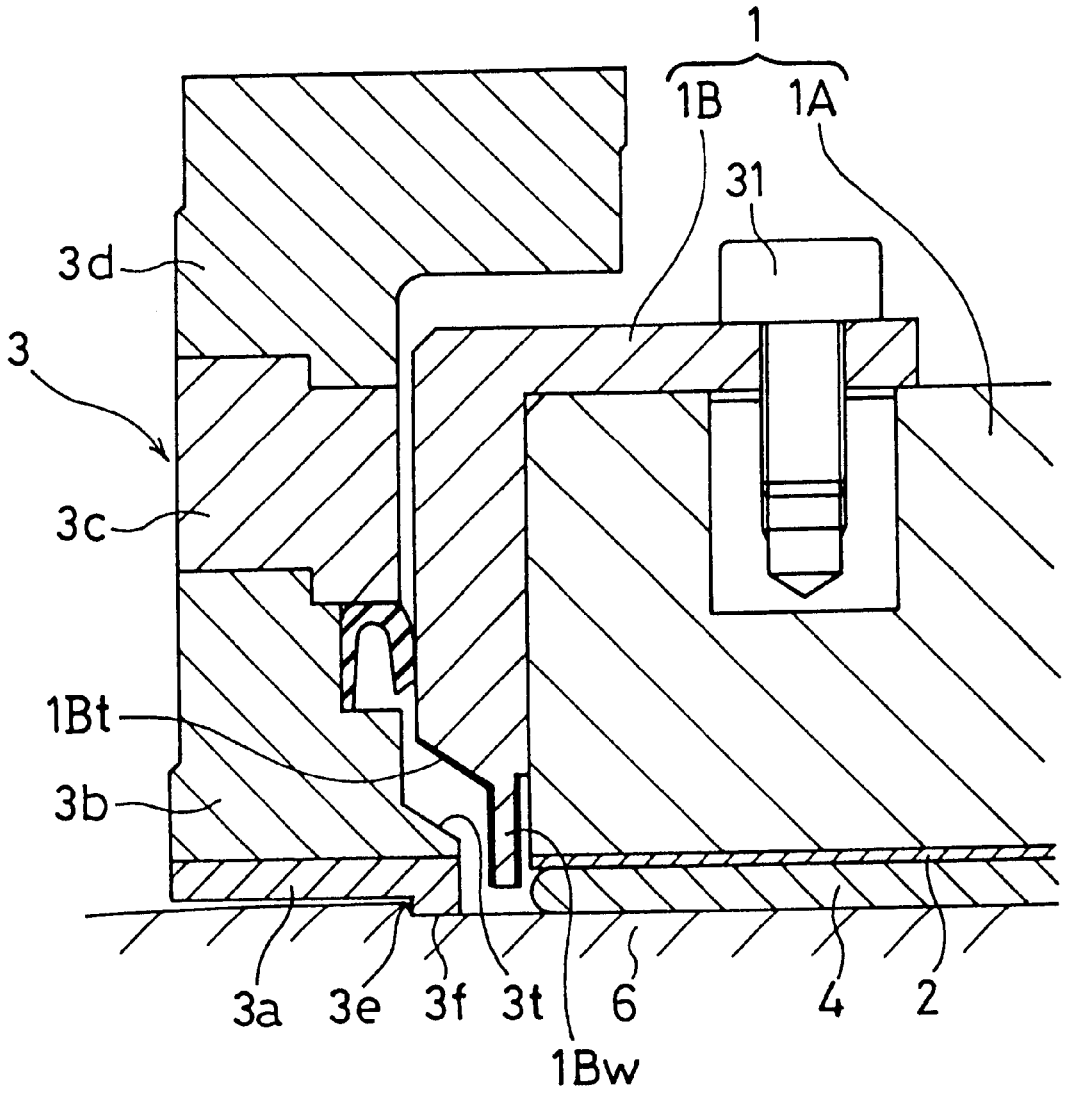
FIG. 4 is an enlarged fragmentary vertical cross-sectional view showing the manner in which the polishing apparatus shown in FIG. 3 operates.

According to the illustrated embodiment, since the ridge 3*e* projects downwardly from the inner peripheral portion of the presser ring 3 and the lower end surface of the ridge 3*e* serves as the pressing surface 3*f* for pressing the polishing cloth 6, the pressing surface 3*f* has a relatively small radial width or thickness. Even if the surface of the polishing cloth 6 and the lower surface of the pressing ring 3 are brought out of parallelism with each other for some reason, since the pressing surface 3*f* on the inner peripheral portion of the presser ring 3 presses the polishing cloth 6, as shown in FIG. 4, the area of the polishing cloth 6 extending from the pressing surface 3*f* to the outer circumferential edge of the semiconductor wafer 4 and further to the radially inner area thereof lies continuously flat providing a continuous and uniform distribution of pressures from the central region to the outer circumferential edge of the semiconductor wafer 4 and further to the pressing surface 3*f* of the presser ring 3 outside of the semiconductor wafer 4. Accordingly, the outer peripheral portion of the semiconductor wafer 4 is prevented from being polished insufficiently or excessively.

Figure 5A:
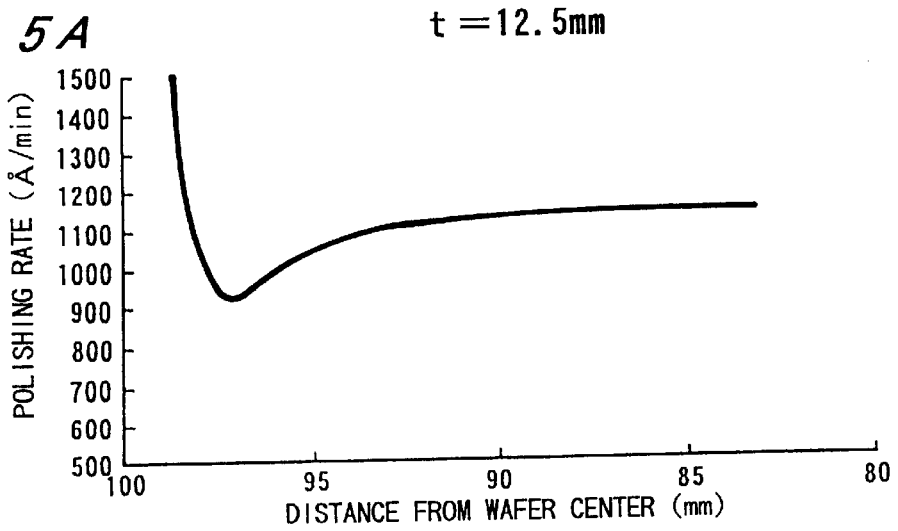
FIGS. 5A through 5C are diagrams showing experimental results obtained when semiconductor wafers were polished by the polishing apparatus with presser rings having pressing surfaces of different radial widths according to the present invention.
Figure 5B:
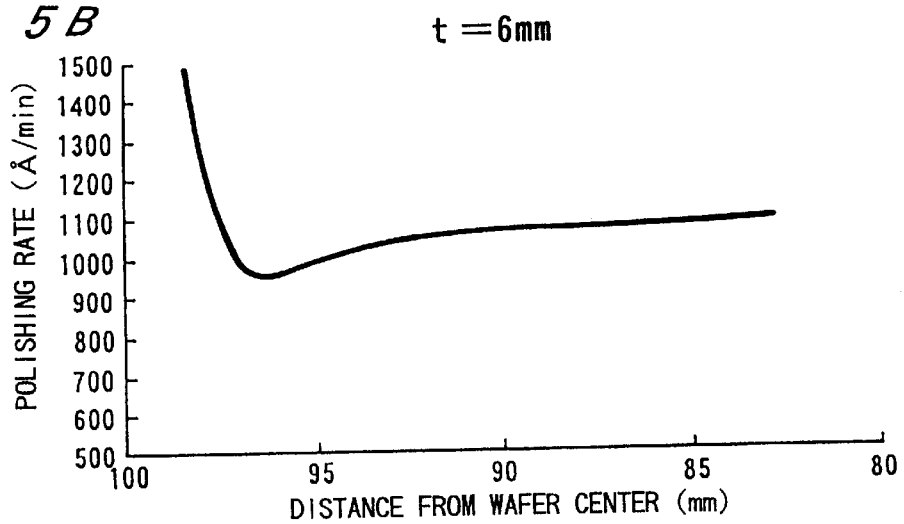
Figure 5C:
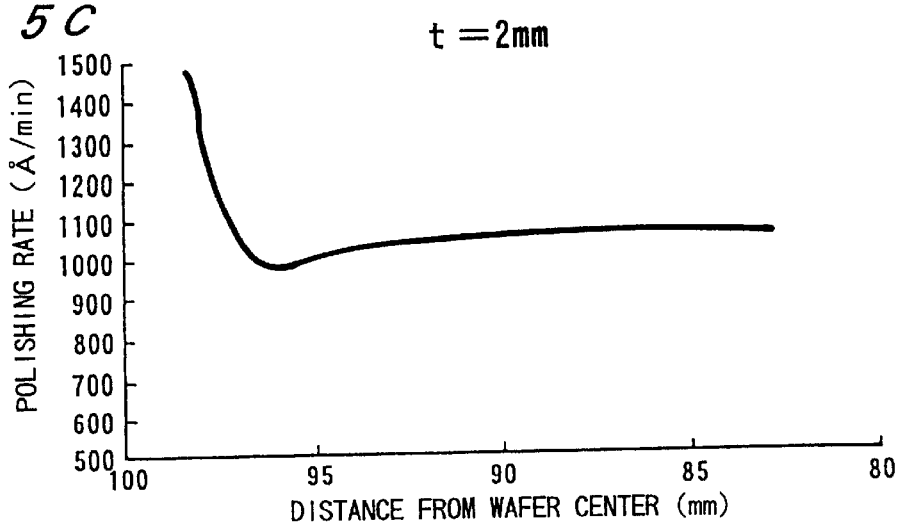

FIGS. 5A through 5C show experimental results obtained when semiconductor wafers were polished by apparatus according to the present invention with the presser rings 3 having pressing surfaces 3*f* of different radial widths. The semiconductor wafers used in the experiment were 8-inch wafers. The pressing force $F_1$ applied by the top ring 1 to the semiconductor wafers was 500 gf/cm$^2$, and the pressing force $F_2$ applied by the presser rings 3 to the polishing cloth 6 was 1000 gf/cm$^2$. FIG 5A shows experimental results when the pressing surface 3*f* has a width t of 12.5 mm, FIG. 5B shows experimental results when the pressing surface 3*f* had a width t of 6 mm, and FIG. 5C shows experimental results when the pressing surface 3*f* had a width t of 2 mm. In each of the graphs shown in FIGS. 5A–5C, the horizontal axis represents the distance (mm) from the center of the semiconductor wafer, and the vertical axis represents the polishing rate (angstrom/minute).

As can be seen from FIGS. 5A–5C, the polishing rate in the radial direction of the semiconductor wafer 4 is affected by the width t of the pressing surface 3*f* of the presser ring 3. Specifically, as the width t of the pressing surface 3*f* of the presser ring 3 decreases, the excessive and insufficient polishing of the outer peripheral portion of the semiconductor wafer 4 is improved. The experimental results prove that the width t of the pressing surface 3*f* of the presser ring 3 should preferably be 6 mm or smaller. If the width t of the pressing surface 3*f* is smaller than 2 mm, then the pressing surface 3*f* cannot press the polishing cloth 6 effectively over the entire area around the outer circumferential edge of the semiconductor wafer 4. Therefore, it is desirable that the width t of the pressing surface 3*f* is at least 2 mm.

The retainer ring 1B has the tapered surface 1Bt and the presser ring 3 has the tapered surface 3*t*, and these tapered surfaces 1Bt, 3*t* are arranged to bring the pressing surface 3*f* as close as possible to the outer circumferential edge of the semiconductor wafer 4 held by the top ring 1. Since the presser ring 3 can press the polishing cloth 6 near the outer circumferential edge of the semiconductor wafer 4, the presser ring 3 is effective in preventing the outer peripheral portion of the semiconductor wafer 4 from being excessively polished.

The retainer ring 1B and the presser ring 3 are made of materials optimum for their functions in the polishing apparatus. Particularly, the retainer ring 1B is made of metal, and the outer, bottom and inner surfaces of the thin wall portion 1Bw are coated with a synthetic resin layer 18 which is relatively soft because the inner surface of the thin wall portion 1Bw is held in contact with the semiconductor wafer 4 and the lower surface thereof is held out of contact with the polishing cloth 6. If the thin wall portion 1Bw of metal is not coated with a soft layer, but exposed, then it would possibly damage the semiconductor wafer 4 during the polishing process. Even when the retainer ring 1B and the presser ring 3 are brought into contact with each other, they contact each other through the synthetic resin layer 18, and hence they are not damaged by each other. Thus, the relative motion (vertical motion and rotating motion) between the presser ring 3 and the retainer ring 1B can be made smoothly.

The first presser ring member 3*a* is held out of contact with the semiconductor wafer 4, is held in contact with the polishing cloth 6. Therefore, the first presser ring member 3*a* is made of a material which is hard and highly resistant to wear and has a low coefficient of friction, such as alumina ceramics.

Specifically, the presser ring 3 should preferably be subject to minimum wear and small frictional resistance upon frictional contact with the polishing cloth 6. Furthermore, particles that are produced from the presser ring 3 when it is worn should not adversely affect semiconductor devices which are formed on the semiconductor wafer 4. Inasmuch as the first presser ring member 3*a* is held out of contact with the semiconductor wafer 4, the above requirements may be met if the first presser ring member 3*a* is made of alumina ceramics or the like. Alternatively, the presser ring 3 may be made of any of various other ceramic materials including silicon carbide (SiC), zirconia, or the like. The presser ring 3 of those materials is subject to minimum wear and produces minimum heat while it is in contact with the polishing cloth 6.

In the first embodiment shown in FIGS. 1 through 5C, there is provided a clearance between the presser ring 3 and the top ring 1 because the presser ring 3 is required to move vertically with respect to the top ring 1. However, there is a possibility that a slurry-like abrasive liquid containing abrasive grains enters the clearance and adheres the presser ring 3 or the top ring 1, thus preventing the presser ring 3 from moving smoothly with respect to top ring 1.

Further, in some cases, the clearance between the presser ring 3 and the top ring is filled with gas such as air, and when polishing is started, although the semiconductor wafer 4 held by the top ring 1 contacts the polishing cloth 6, the presser ring 3 does not move downwardly and contact the polishing cloth 6, and hence the presser ring 3 cannot press the polishing cloth 6 timely. It is desirable that the presser ring 3 contacts the polishing cloth 6 at the same time or earlier than the time that the semiconductor wafer 4 held by the top ring 1 contacts the polishing cloth 6.

It is therefore an object of a second embodiment of the present invention to provide a polishing apparatus which allows the presser ring to vertically move smoothly with respect to the top ring.

Figure 6:
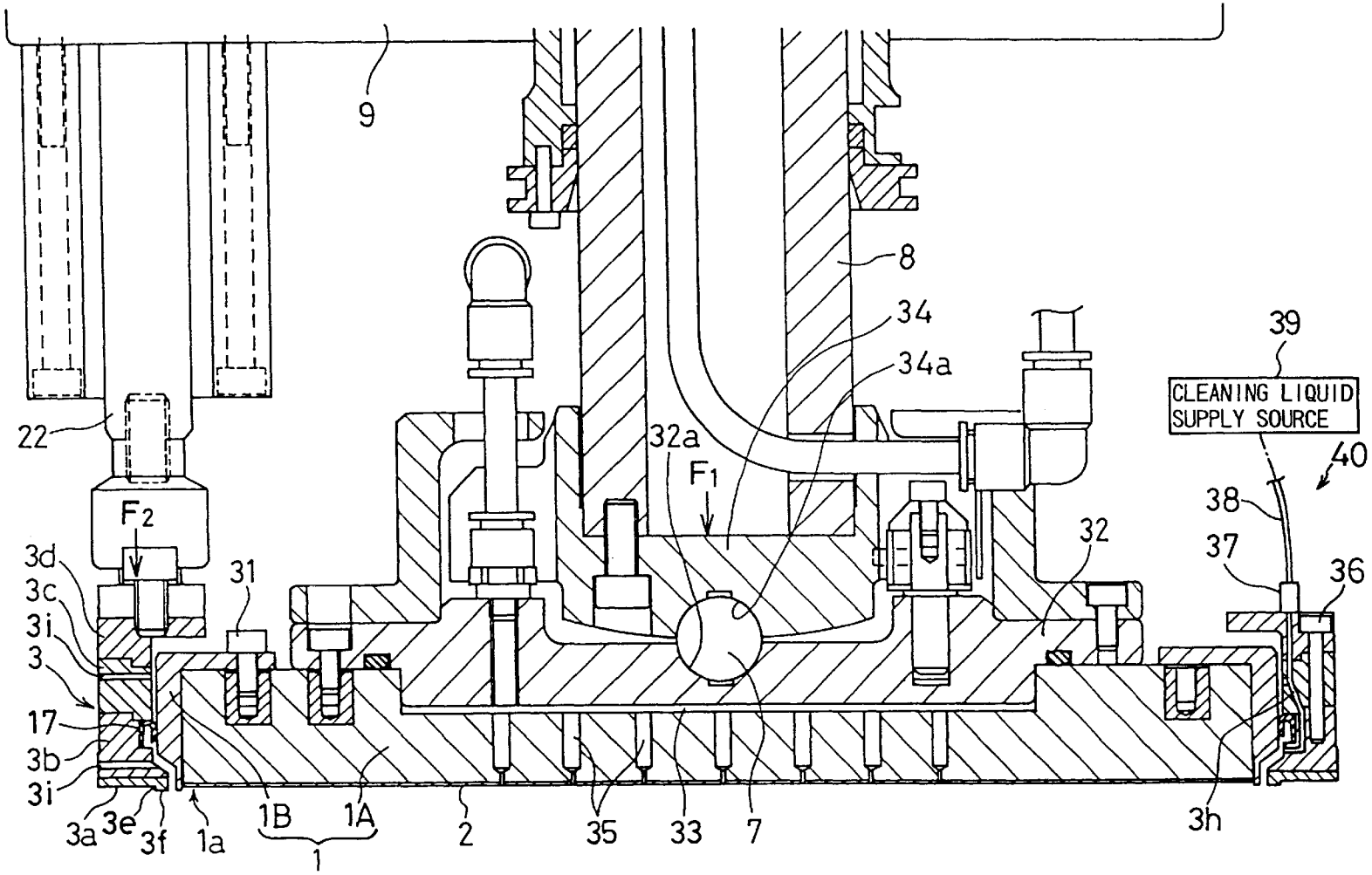
FIG. 6 is an enlarged fragmentary vertical cross-sectional view of the polishing apparatus according to a second embodiment of the present invention.
Figure 7A:
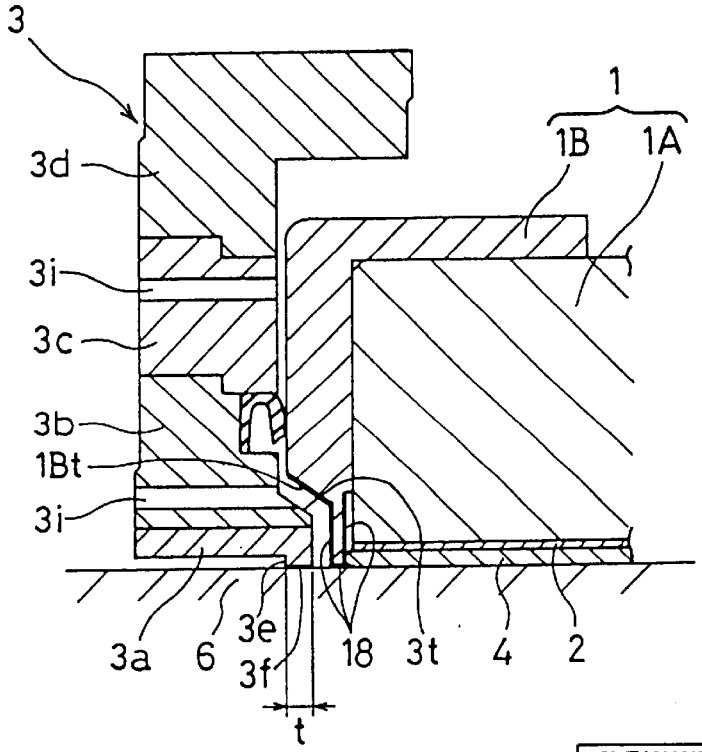
FIGS. 7A and 7B are enlarged fragmentary vertical cross-sectional views of portions of the polishing apparatus shown in FIG. 6.
Figure 7B:
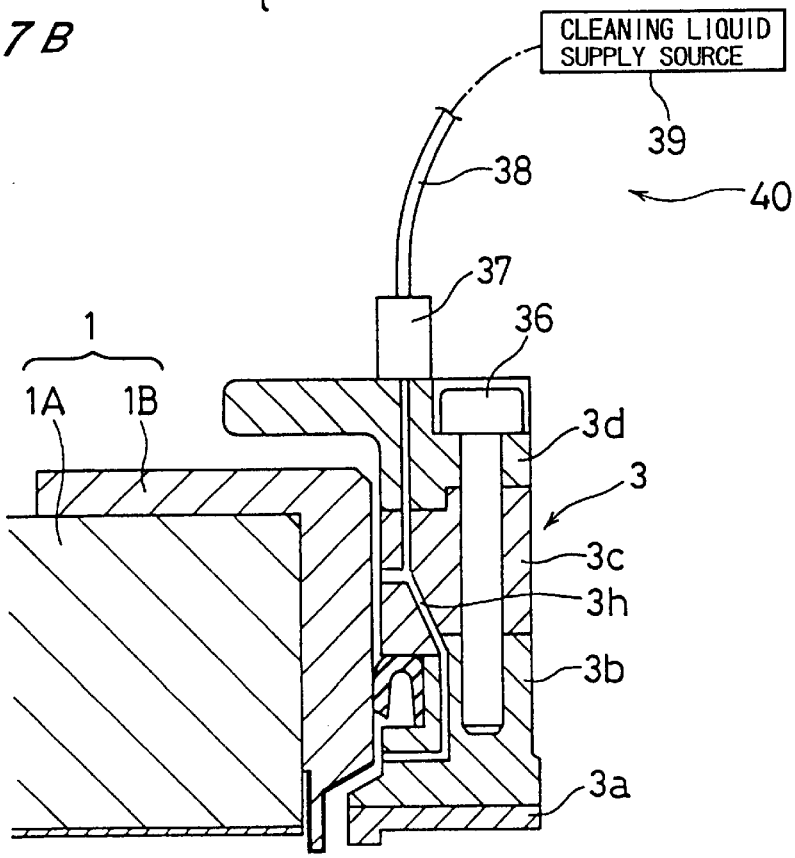
Figure 8:
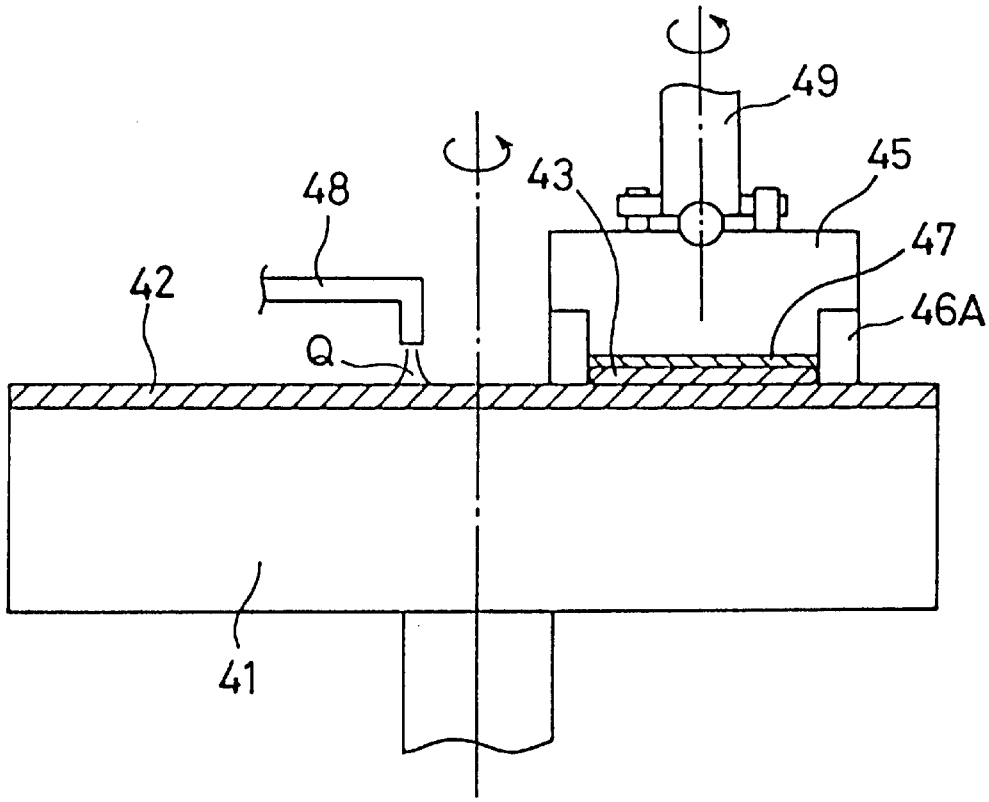
FIG. 8 is a vertical cross-sectional view of a conventional polishing apparatus.
Figure 9:
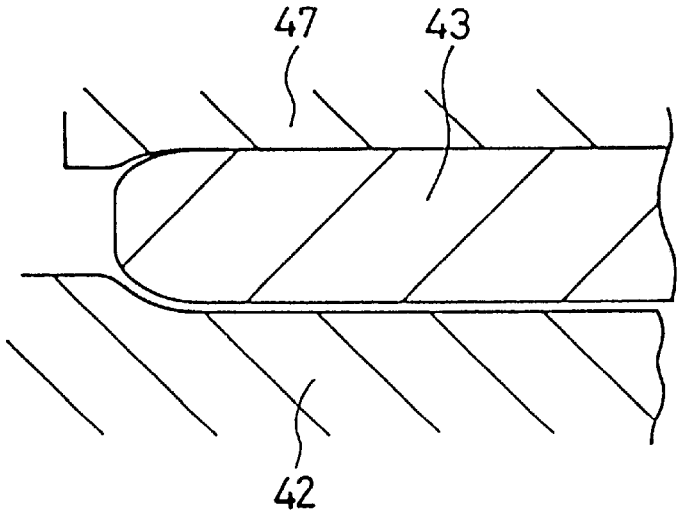
FIG. 9 is an enlarged fragmentary vertical cross-sectional view showing the state of a semiconductor wafer, a polishing cloth, and an elastic pad while the semiconductor wafer is being polished by the conventional polishing apparatus.
Figure 10:
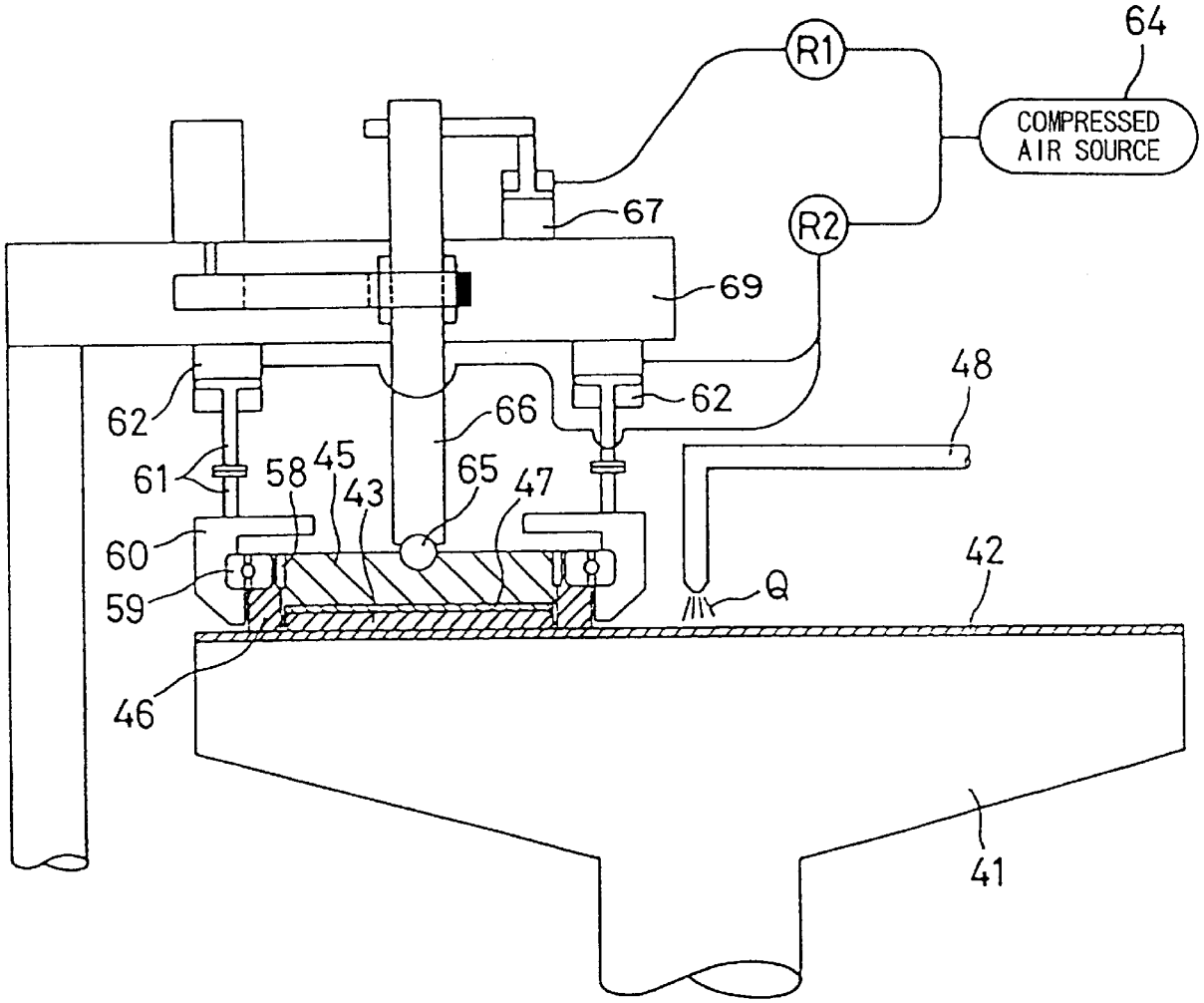
FIG. 10 is a vertical cross-sectional view of a polishing apparatus which has been proposed by the applicant of the present invention.
Figure 11:
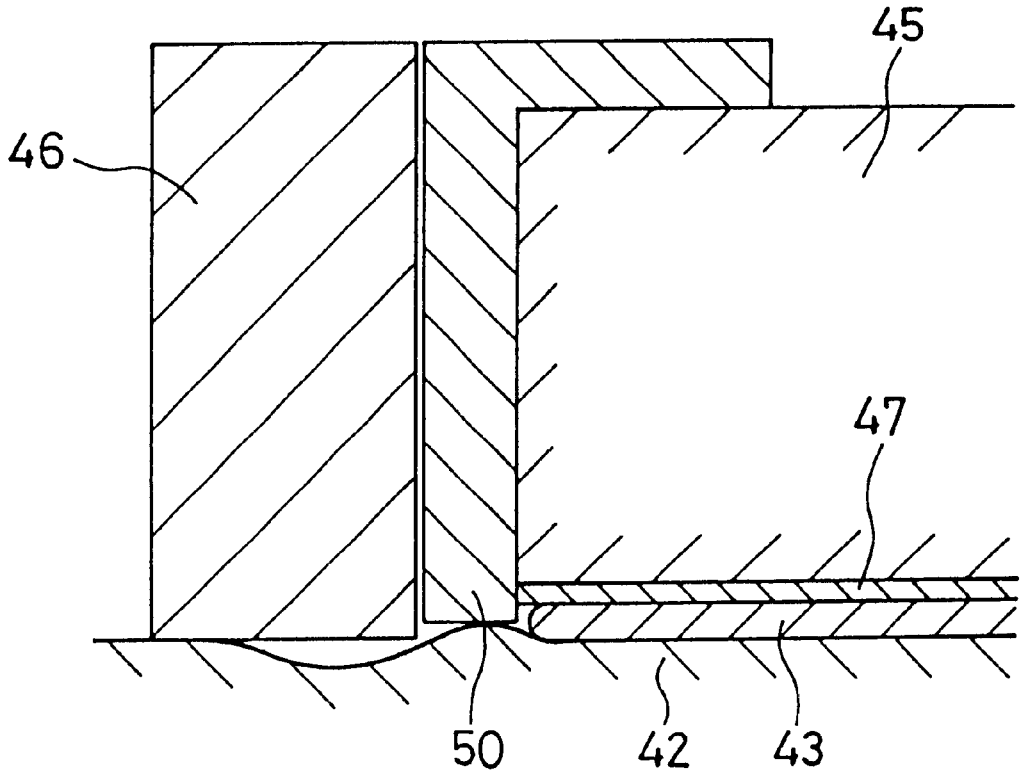
FIG. 11 is an enlarged fragmentary cross-sectional view showing the relationship of a retainer ring fixed to the top ring, the presser ring and the polishing cloth.

FIGS. 6, 7A and 7B show the second embodiment of the present invention. As shown in FIG. 6, according to this embodiment, a cleaning liquid supply device 40 is provided to supply a cleaning liquid to the clearance between the presser ring 3 and the retainer ring 1B of the top ring 1. As shown in FIGS. 6 and 7B, the presser ring 3 has a cleaning liquid supply hole 3*h* whose ends are open at the inner circumferential surface of the presser ring 3. The above openings are provided at upper and lower sides of the elastic member 17. The other end of the cleaning liquid supply hole 3*h* is open at the upper end of the presser ring 3. The other end of the cleaning liquid supply hole 3*h* may be open at the outer circumferential surface of the presser ring 3. A tube 38 is connected to the cleaning liquid supply hole 3*h* of the presser ring 3 through a connector 37, and the tube 38 is connected to a cleaning liquid supply source 39. The cleaning liquid supply hole 3*h*, the connector 37, the tube 38 and the cleaning liquid supply source 39 jointly constitute the cleaning liquid supply device 40. Since the presser ring 3 is nonrotatable, a cleaning liquid can be easily supplied from the cleaning liquid supply source 39 to the cleaning liquid supply hole 3*h* without providing a rotary joint.

By supplying properly the cleaning liquid to a clearance between the presser ring 3 and the retainer ring 1B of the top ring 1 from the cleaning liquid supply device 40, a slurry-like abrasive liquid which has entered the clearance can be washed away with the cleaning liquid. Therefore, the abrasive liquid does not adhere to the inner surface of the presser ring 3 and the outer surface of the retainer ring 1B of the top ring 1, and the presser ring 3 can be vertically moved smoothly.

Further, as shown in FIGS. 6 and 7A, a plurality of vent holes 3*i* are formed in the presser ring 3 to discharge gas such as air trapped in the clearance between the presser ring 3 and the retainer ring 1B of the top ring 1. Therefore, gas is not trapped in the clearance between the presser ring 3 and the retainer 1B of the top ring 1, and the vertical motion of the presser ring 3 can be made smoothly. Thus, when polishing is started, the presser ring 3 can contact the polishing cloth 6 in exact timing and can press the polishing cloth 6 at a desired value.

Although certain preferred embodiments of the present invention have been shown and described in detail, it should be understood that various changes and modifications may be made therein without departing from the scope of the appended claims.

What is claimed is:

1. A polishing apparatus for polishing a workpiece, said apparatus comprising:

a turntable providing a polishing surface;

a top ring for holding a workpiece and pressing the workpiece against said polishing surface under a first pressing force to polish the workpiece;

a presser ring positioned outwardly of said top ring, said presser ring being vertically movable relative to said top ring and having a first member made of SiC which is to be held in contact with said polishing surface; and a pressing device for pressing said presser ring against said polishing surface under a second pressing force which is variable, wherein said top ring is rotatable relative to said presser ring.

2. A polishing apparatus according to claim 1, wherein said ceramics comprises one of alumina ceramics and SiC.

3. A polishing apparatus for polishing a workpiece, said apparatus comprising:

a turntable providing a polishing surface;

a top ring for holding a workpiece and pressing the workpiece against said polishing surface under a first pressing force to polish the workpiece;

a presser ring positioned outwardly of said top ring, said presser ring being vertically movable relative to said top ring;

a pressing device for pressing said presser ring against said polishing surface under a second pressing force; and a cleaning liquid supply device for supplying a cleaning liquid to a clearance between said top ring and said presser ring, wherein said cleaning liquid supply device is operable to supply the cleaning liquid after polishing the workpiece and before polishing a subsequent workpiece.

4. A method for processing a workpiece, said method comprising:

holding a workpiece between a polishing surface of a turntable and a top ring;

pressing a presser ring, that is vertically movable relative to said top ring and that is positioned outwardly of said top ring, against said polishing surface and around said workpiece under a first pressing force;

pressing said workpiece against said polishing surface under a second pressing force to polish said workpiece; and supplying a cleaning liquid to a clearance between said top ring and said presser ring after polishing the workpiece and before polishing a subsequent workpiece.

5. A holder for holding a workpiece, said holder comprising:

a top ring for holding a workpiece and pressing the workpiece against a polishing surface under a first pressing force to polish the workpiece;

a presser ring positioned outwardly of said top ring, said presser ring being vertically movable relative to said top ring;

a pressing device for pressing said presser ring against the polishing surface under a second pressing force; and a cleaning liquid supply device for supplying a cleaning liquid to a clearance between said top ring and said presser ring, wherein said cleaning liquid supply device is operable to supply the cleaning liquid after polishing the workpiece and before polishing a subsequent workpiece.

6. A polishing apparatus for polishing a work piece, said apparatus comprising:

a turntable providing a polishing surface;

a top ring for holding a workpiece and pressing the workpiece against said polishing surface under a first pressing force to polish the workpiece;

a presser ring positioned outwardly of said top ring, said presser ring to be pressed against said polishing surface under a second pressing force which is variable, and said presser ring having a first member made of SiC which is to be held in contact with said polishing surface, wherein said top ring is rotatable relative to said presser ring.

7. A holder for holding a workpiece, said holder comprising:

a top ring for holding a workpiece and pressing the workpiece against a polishing surface under a first pressing force to polish the workpiece;

a presser ring positioned outwardly of said top ring, said presser ring being vertically movable relative to said top ring;

a pressing device for pressing said presser ring against the polishing surface under a second pressing force; and a cleaning liquid supply device for supplying a cleaning liquid to a clearance between said top ring and said presser ring, wherein said cleaning liquid supply device is operable to supply the cleaning liquid when the workpiece is not being polished.

8. A polishing apparatus according to claim 6, wherein said ceramics comprises one of alumina ceramics SiC.

* * * * *

UNITED STATES PATENT AND TRADEMARK OFFICE

CERTIFICATE OF CORRECTION

PATENT NO. : 6,428,403 B1
DATED : August 6, 2002
INVENTOR(S) : Norio Kimura et al.

It is certified that error appears in the above-identified patent and that said Letters Patent is hereby corrected as shown below:

Title page,
Item [30], please add the following:
-- Foreign Application Priority Data
April 8, 1997 (JP) …….. 105252/1997
April 8, 1997 (JP) …….. 105253/1997
April 8, 1997 (JP) …….. 105254/1997 --

Column 12, lines 41-42 and Column 14, lines 28-29,
Delete claims 2 and 8

Signed and Sealed this

Seventh Day of September, 2004

JON W. DUDAS
*Director of the United States Patent and Trademark Office*